United States Patent [19]

Macri

[11] 3,986,909

[45] Oct. 19, 1976

[54] BORON-FUEL-RICH PROPELLANT COMPOSITIONS

[75] Inventor: Bruno J. Macri, Springfield, Va.

[73] Assignee: Atlantic Research Corporation, Alexandria, Va.

[22] Filed: Mar. 24, 1970

[21] Appl. No.: 25,607

[52] U.S. Cl. ..... 149/19.9; 149/5; 149/20; 149/22; 149/113; 149/114

[51] Int. Cl.[2] ..... C06D 5/06

[58] Field of Search ..... 149/19, 22, 5, 6, 113, 149/114, 76, 19.9, 20

[56] References Cited

UNITED STATES PATENTS

| | | | |
|---|---|---|---|
| 2,926,613 | 3/1960 | Fox | 149/87 X |
| 3,005,693 | 10/1961 | Thomas et al. | 149/114 X |
| 3,133,841 | 5/1964 | Kuehl | 149/5 |
| 3,317,360 | 5/1967 | Young et al. | 149/22 X |
| 3,407,100 | 10/1968 | Scurlock et al. | 149/19.4 X |
| 3,418,183 | 12/1968 | Rice | 149/6 |
| 3,454,437 | 7/1969 | Yamazaki et al. | 149/19 X |
| 3,476,622 | 11/1969 | Harada et al. | 149/19 |
| 3,507,719 | 4/1970 | Hodgson | 149/22 X |
| 3,761,330 | 9/1973 | Lou et al. | 149/21 |

OTHER PUBLICATIONS

Siegal et al., "Energetics of Propellant Chemistry", p. 143, John Wiley and Son (1964).

*Primary Examiner*—Richard D. Lovering
*Assistant Examiner*—Edward A. Miller
*Attorney, Agent, or Firm*—Martha L. Ross

[57] ABSTRACT

Fuel-rich propellant compositions, for use in air-augmented rocket propulsion, containing a high-energy fuel component in the form of finely-divided boron, wherein the boron is present in large excess of the amount oxidizable during combustion of the propellant. A major portion of the boron is ejected, largely as free boron particles, together with the combustion products of the propellant and is burned downstream of the propellant by ram air injected into an afterburner combustion zone. The propellant additionally comprises an organic fuel binder comprising an organic polymer, and an inorganic oxidizer salt, preferably ammonium perchlorate, in an amount at least sufficient to maintain stable combustion of the propellant at desired combustion chamber pressures. The propellant compositions may additionally contain small amounts of Mg, Al, or Zr metal as ballistic or afterburner combustion modifiers.

Ejection of the boron is substantially improved by incorporating at least a portion of the boron in the propellant composition in the form of agglomerate masses or particles. Preferably the agglomerate particles are spheroidal and the finely-divided boron in the agglomerate particles is bonded together by a matrix of an organic polymer. From 0 to 100% of the oxidizer salt is admixed with the boron in the agglomerate particles. Inclusion of the oxidizer with the metallic fuel in the agglomerate particles provides a substantial increase in propellant pressure exponent, which is highly desirable in certain applications. The Mg, Al, or Zr metal modifiers when present, may be incorporated wholly in the organic fuel binder, wholly in the agglomerate particles, or distributed therebetween.

12 Claims, No Drawings

BORON-FUEL-RICH PROPELLANT COMPOSITIONS

BACKGROUND OF THE INVENTION

Air-augmented rocket propulsion is a means for very substantially increasing the range or payload of a rocket vehicle whose trajectory is confined within the earth's atmosphere. Such vehicles comprise a booster motor or stage wherein a conventional stoichiometric solid propellant accelerates the vehicle to velocities adequate to force ram air at sufficiently elevated pressure and temperature into the afterburner stage for combustion of combustible products produced by combustion of the fuel-rich propellant in the sustainer stage. By stoichiometric is meant a propellant oxidizer content sufficient at least to oxidize all of the available carbon in the propellant binder to carbon monoxide and any other high-energy fuel additive, such as metal, substantially fully to its stable oxide. Available carbon means carbon not already oxidized or oxidizable by an oxidizing element molecularly combined in the organic binder.

A second or sustainer stage comprises a combustion chamber containing a fuel-rich solid propellant, namely a propellant containing sufficient available oxidizer component to sustain combustion of the propellant, but insufficient to oxidize the high-energy boron fuel additive after substracting the oxidizer requirements of the organic binder for oxidation of its available carbon to carbon monoxide. The term "binder" includes, in addition to an organic polymer, organic additives, such as plasticizers, burning rate catalysts, stabilizers, dispersing agents, and the like, which contain carbon available for combustion. Accordingly, when such a fuel-rich propellant burns, a major proportion of the high-energy additive is ejected with the combustion products of the fuel-rich propellant as free boron and generally, small amounts of its stable and lower metal oxides, the latter of which are then available for combustion downstream of the propellant in an afterburner combustion zone or stage into which ram air is introduced. Additionally, other underoxidized or unoxidized products, such as CO, $H_2$ and C, are also available for combustion in the afterburner stage. The high temperature, high pressure combustion products vent through a rocket nozzle to produce thrust.

Such fuel-rich, solid propellants per se are low performance propellants and have substantially lower specific impulse than conventional, stoichiometric propellants, but this is greatly counterbalanced by the combustion in the afterburner, which can contribute additional specific impulse of as much as 600 to 900.

The increased air-augmented vehicle range (or conversely higher payload for a given range) is achieved by very substantial weight reduction in the oxidizer component of the sustainer propellant and the utilization of ram air to complete combustion of ejected unoxidized or incompletely oxidized combustion products in the afterburner.

Since an air-augmented rocket system is more complex than a conventional rocket because of its requirement for ram air ducts and stable afterburning, successful performance trade-off requires a fuel-rich propellant that burns stably and efficiently to provide maximum quantities of combustible after products, particularly free, high-energy metal fuel, in a form which will burn efficiently and completely in the afterburner.

Thus the formation of combustion product residues, such as metal oxides in the form of slag, which encase the free metal and prevent its injection into the afterburner in readily combustible form, must be minimized. Boron is a preferred metal in air-augment propulsion because of its very high heat of combustion per unit mass and per unit volume. However, ejection problems can be particularly severe in the case of boron. Development of boron-fuel-rich propellants having high ejection efficiency has posed difficulties.

In-flight controllability of the degree of thrust on command is a very desirable feature in an air-augmented rocket system since it permits flexibility in speed, manueverability, trajectory. and range. To be effective, response time of the rocket must be rapid. An effective way to achieve controllability is by using a boron-fuel-rich propellant having a relatively high pressure exponent (n). The higher the pressure exponent, the greater is the rate of burning rate increase for a given increase in combustion chamber pressure. Thus for a relatively small range of combustion chamber pressures, produced, for example, by a pintle nozzle on command, substantial and rapid increase or decrease in burning rate and, therefore, in thrust, can be achieved. It has, however, been difficult to produce boron-fuel-rich propellants having relatively high pressure exponents.

Agglomerate particles of metal fuel and of metal fuel oxidizer and burning rate catalyst have been suggested by U.S. Pat. Nos. 3,133,841 and 3,454,437 for use in conventional essentially stoichiometric propellants wherein the function of the metal fuel component is primarily to burn as a component part of the propellant per se and thereby to increase the specific impulse and performance of the propellant. In U.S. Pat. No. 3,133,841 agglomeration of small metal particles is recommended to reduce pyrophoricity and thereby handling problems. In U.S. Pat. No. 3,454,437, a blend of metal, oxidizer, and burning rate catalyst are agglomerated in order to increase the amount of oxidizer that can be introduced into the propellant, and, thereby, increase the per se performance and specific impulse of the conventional propellant. U.S. Pat. No. 3,377,955 is concerned with the problem of incorporating exotic, highly reactive fuels, such as lithium hydride, into a propellant and resolves this by providing fuel cores, such as pharmaceutical-size tablets comprising the reactive fuel, preferably with a non-reactive coating. They do not address themselves to low-performance fuel-rich propellants for use in air-augment propulsion systems wherein a major objective is efficient ejection of boron by the propellant into an afterburner stage or the particular problems attendant thereto. Boron per se, like aluminum, is not an exotic or highly reactive fuel and can be readily incorporated in powder form into a propellant composition without posing problems of reactivity.

The objective of the invention is to provide improved boron-fuel-rich propellant compositions, for use in air-augmented rocket motor systems, which are characterized during combustion by increased ejection of free boron for combustion in the afterburner zone and which thereby improve total performance of the systems.

Another object is to provide improved boron-fuel-rich propellants, for use in such systems, which are characterized by substantially increased pressure exponents.

Still another object is to provide improved boron-fuel-rich propellants characterized by relatively high pressure exponents which, thereby, are particularly useful in controllable air-augment rocket propulsion systems.

SUMMARY OF THE INVENTION

The invention relates to improvement in the ejection efficiency of boron in boron-fuel-rich propellant compositions for use in air-augmented rocket propulsion systems. It also relates to a means for increasing the pressure exponent of such propellants for certain applications.

The propellant compositions comprise a fuel binder comprising an organic polymer, an inorganic oxidizer salt, and finely-divided boron. The term "binder" as used herein also includes such conventional additives as organic plasticizers, burning rate catalysts, stabilizers, dispersing agents, and the like, which contain carbon available for combustion to carbon monoxide. The boron fuel is present in amount at least 25%, preferably at least about 40% by weight of the propellant. The binder is present in an amount comprising at least about 10%, preferably at least about 15%, by weight of the propellant to impart adequate processing and physical properties and to provide adequate gaseous products to entrain the ejected boron particles and carry them into the afterburner. The oxidizer salt is present in an amount adequate to maintain combustion of the propellant composition, the maximum amount of the oxidizer being about the calculated amount required to oxidize available carbon in the binder to carbon monoxide. Preferably substantially less than this stoichiometric equivalent of oxidizer is incorporated.

Such propellants are designed to eject, during combustion, large quantities of unoxidized and underoxidized components into an afterburner stage where they are burned with injected ram air, thereby producing large increments of specific impulse and thrust.

The high energy boron injected into the afterburner is of major importance because of the high energy and impulse that it contributes. For this reason, the stoichiometry of the propellant is such that the available oxygen provided by the oxidizer salt is sufficient only to oxidize all or only a portion of the available carbon to carbon monoxide, so that no excess oxygen is theoretically available for combustion of the boron. In practice, the chemical reactions and equilibrium during combustion are such that despite such oxidizer equivalency and the preferential reaction of carbon with the available oxygen, a small amount of the carbon may eject as free carbon and a small amount of the boron oxidizes to its lower oxides and its stable oxide, namely the oxide formed with the characteristic valence of the metal. However, by limiting oxidizer theoretically to carbon equivalency, preferably less, the larger is the proportion of metal available for ejection as free metal particles for combustion in the afterburner.

Boric oxide, ($B_2O_3$), the stable metal oxide formed by combustion of the boron tends to form hard slag-like residues which entrain or encase the free boron particles, thereby reducing ejection efficiency of the free boron particles for afterburner combustion and total available performance of the propulsion system.

It has been found that when at least a portion of the boron in the propellant is in the form of agglomerate particles, ejection efficiency of the metal fuel is substantially improved as compared with the ejection efficiency of a similar propellant containing the boron particles only in a substantially unagglomerated state.

The agglomerate particles essentially comprise particles of finely-divided boron as the fuel component bonded together into larger particles in any suitable manner, preferably by means of an organic polymer. The agglomerate particles can be of any desired shape and are preferably spheroidal. During combustion, the agglomerates rapidly disintegrate freeing the finely-divided particles for combustion and ejection.

For air-augmented rocket systems applications that require thrust controllability during flight, it is desirable to employ a boron-fuel-rich propellant having relatively high pressure exponents, for example, higher than 0.5. It has been found that pressure exponent of the boron-fuel-rich propellants can be substantially increased by admixing at least a portion and as much as 100% of the total inorganic oxidizer salt with the metallic fuel in the agglomerate particles to form composite boron oxidizer agglomerates. Ammonium perchlorate is the preferred inorganic oxidizer salt.

Mg, Al, or Zr metal may be added as ballistic modifiers to the propellant composition, generally in amounts up to about 50%, preferably up to about 20%, by weight of the boron. Such additional metal can be incorporated into the propellant composition wholly as a component of the aggregate particles, wholly dispersed in powder form in the organic fuel binder, or distributed therebetween.

DESCRIPTION OF THE INVENTION

The propellant compositions, which are designed for air-augment-type rocket propulsion, comprise boron in an amount comprising at least about 25%, and preferably at least about 40%, by weight of the total propellant. Total boron can be as high as about 65% by weight.

At least about 5%, preferably at least about 10%, by weight of the total boron is incorporated in the form of agglomerate particles formed by bonding the boron powder into an agglomerate. The remainder, if any, of the boron powder is distributed in the propellant fuel binder.

The agglomerate particles can be made in any desired manner, so long as the bond holding the boron particles in the aggregate readily disintegrates during combustion of the propellant.

Bonding of the particles of boron powder can be accomplished for example, by means of pressure preferably with the assistance of an adhesive, or by concentrating them within a matrix of an organic polymer binder. The latter is preferred because of the ease of disintegration of the agglomerates during combustion.

The agglomerate particles can be of any desired shape and can be produced, for example, by comminuting a sheet, rod, or block of the agglomerated boron powder into aggregate particles of the desired size. Spheroidal agglomerate particles are preferred since they considerably improve processability of the propellant, particularly in view of the high solids loadings required. Such spheroidal agglomerates can be made in any desired manner. A particularly preferred process for making such spheroidal agglomerates, wherein the boron powder is bonded by a matrix of an organic polymer is disclosed in copending application Ser. No. 884,697, filed Dec. 12, 1969, and now U.S. Pat. No. 3,646,174. The process as described therein for making spheroidal agglomerates of particulate boron, with or without other added solids such as ammonium perchlorate, bonded by a matrix of an organic polymer, comprises mixing the solid particles with an organic liquid prepolymer curable to a solid polymer, and a volatile liquid which is immiscible with the prepolymer and does not dissolve the solid particles; and continuously agitating the resulting mixture while removing the volatile liquid. During such simultaneous agitation and removal, the prepolymer and solids coalesce into globules containing the particles dispersed therein. The agitation and removal continues until the prepolymer sets into a solid polymer.

Some examples of liquid prepolymers further polymerizable to solid polymers include polybutadiene, hydroxy- and carboxy-terminated polybutadiene, polybutadiene acrylic acid, polyurethane, organic polysulfides, ethyl acrylate-acrylic acid copolymer, epoxies, acrylates and methacrylates, polyesters, polyamides, and many others. The prepolymer can be selected for its compatibility with materials in which the spheroidal agglomerates may be embedded, as for example, the organic polymer binder of a propellant grain. Carboxy-terminated polybutadiene is a preferred polymer. The polymer content of the agglomerate particles is preferably held to a minimum, e.g. up to about 20% by weight, preferably up to about 10%.

The preferred size range of a major proportion by weight of the agglomerate particles is about −12 to +60 mesh, Tyler Standard Sieve size, preferably about −16 to +48. Generally, it is preferred to incorporate the agglomerate particles into the propellant mix in a range of size since this generally improves processing of the propellant.

The preferred size range of the boron powder particles in the fuel binder and/or the agglomerate particles is about 0.1$\mu$ to 25$\mu$, preferably about 0.5$\mu$ to 15$\mu$.

The inorganic oxidizer salt may be any of the conventional oxidizer salts used in composite propellant compositions including, for example, the ammonium and alkali metal, e.g. Na, K, Li, chlorates, perchlorates, and nitrates. For many applications, ammonium perchlorate is preferred.

The oxidizer is incorporated in amount at least sufficient to maintain active combustion of the propellant compositions under the conditions of use, namely the combustion chamber pressures to be maintained in the particular application. Such combustion specifically involves combustion of the organic fuel binder. The maximum amount of oxidizer incorporated is about the amount theoretically required to oxidize the available carbon in the binder to carbon monoxide. Preferably less than such maximum amount is used, consistent with the required maintenance of combustion and desired temperature of the combustion products of the propellant. Use of amounts of oxidizer within the foregoing restraints maximizes the amount of free boron ejected for afterburning, although some of the boron does oxidize to its stable and lower oxides. In general, the minimum amount of oxidizer required is about 15%, preferably about 20%, by weight of the total propellant composition.

The organic fuel binder can comprise any of the organic polymers conventionally used in solid propellants, including for example, polybutadiene, carboxy or hydroxy terminated polybutadiene, polybutadiene acrylic acid, polybutadiene acrylonitrile, nitrocellulose, polyvinyl chloride, polyvinyl acetate, cellulose acetate, methyl or ethyl methacrylate or acrylate, ethyl acrylate-acrylic acid, polyamides, polysulfides, polyurethane, polyethylene, polytetrafluoroethylene, and many others.

The organic polymer can be plasticized as required with plasticizers known in the art effective for the particular polymer used. Such plasticizers include, for example, the dibutyl, dihexyl, dioctyl, dinonyl, didecyl, and didodecyl phthalates, adipates, and sebacates; isodecyl pelargonate, triacetin, polyethylene glycol, nitroglycerine, trimethylolethane trinitrate, and many others. The amount of plasticizer used is generally within the skill of the art and is determined by such factors as the particular polymer, the particular plasticizer, and the desired physical properties of the propellant grain.

Additionally, the binder can contain other additives such as stabilizers, wetting agents, and ballistic modifiers, e.g. burning rate catalysts or inhibitors, cooling agents, and the like.

For adequate physical and ballistic properties of the propellant, the organic fuel binder should be present in amount at least about 10% by weight of total propellant and preferably at least about 15% by weight.

In some cases, it may be desirable to incorporate a small proportion, generally about 10% or less, preferably up to about 4%, by weight of the propellant, of Al, Mg, or Zr as ballistic modifiers. Such metals, for example, can improve the combustion efficiency of the combustible products, such as the free boron in the afterburner. Such added metals can be incorporated in finely-divided form entirely in the organic fuel binder of the propellant. They can also optionally be incorporated, in whole or in part, in the boron-containing agglomerate particles.

Processing, casting, and curing of the propellant grains can be accomplished by any known procedures. The boron-containing agglomerate particles can be first admixed with other finely-divided solids or separately added to the propellant mix. In addition to the ballistic advantages imparted by the boron-containing agglomerate particles, they also improve processability of the propellant mixes.

Residue formation resulting from the combustion of air-augment boron propellants is apparently due to at least two factors: the relatively low flame temperatures produced by such highly fuel rich propellants and the condensation of the boric oxide ($B_2O_3$) into a hard slag at these relatively low temperatures. The slag apparently entraps free boron particles as they eject with the combustion products of the propellant, thereby preventing their combustion in the afterburner. Since the free boron is an essential afterburner fuel component for achieving the high over-all performance of the air-augment propulsion system, such residue entrapment reduces total specific impulse of the system.

The reasons for the improved free boron ejection efficiency achieved with the boron agglomerate particles is not fully understood. In any case, it has been observed that residue formation is substantially reduced by agglomerating at least a portion of the boron fuel.

This phenomenon is clearly demonstrated by the examples in Table I of test motor firings of propellant compositions made with and without the boron in the form of bonded agglomerate particles. All composition percentages are by weight of total propellant. The boron used was ball-milled Ampot boron made by American Potash and Chemical Corporation. The ball-milled boron had a nominal particle size of about 12 to 15μ as compared with a pre-ball-milled particle size of about 2–3μ. Ampot boron has a nominal composition of about 91% boron, about 5–6% Mg and about 3–4% inerts, such as $B_2O_3$ and water. The boron particles were bonded with about 6% by weight iron glue in the form of spherical particles or beads.

The test motors were of two sizes as follows and utilized grains with axial cylindrical bores(C).

| | 1 | 2 |
|---|---|---|
| OD grain | 3.3" | 6" |
| ID grain (bore) | 1.8" | 4" |
| Grain length | 6" | 11.4" |

All motors were fired at nominal combustion chamber pressures of about 1000 psia and at a temperature of 70° F.

TABLE I

| Motor Type | | % Boron | % Boron in beads | % AP[1] | % Propellant Binder[2] | % b.r. catalyst[3] | % residue |
|---|---|---|---|---|---|---|---|
| 3.3C1.8-6 | 164 | 30 | 0 | 45.9 | 24.1 | 0 | 4.99 |
| 3.3C1.8-6 | 166 | 30 | 100 | 45.9 | 24.1 | 0 | 1.04 |
| " | 162 | 39 | 100 | 40. | 29. | 0 | 2.9 |
| 6C4-11.4 | 171 | 50 | 100 | 29. | 21. | 0 | 5.78[4] |
| " | 159 | 45 | 0 | 25. | 30. | 0 | 20.7 |
| " | 173 | 50 | 100 | 29. | 19. | 2 | 4.46 |
| " | 181 | 50 | 100 | 29. | 17. | 4 | 2.65 |
| " | 179 | 45 | 0 | 28. | 23. | 4 | 9.08 |
| " | 177A | 55 | 100 | 22. | 22.3 | 4 | 5.0 |
| " | 165A | 45 | 0 | 25. | 26. | 4 | 10.35 |

[1]Ammonium perchlorate
[2]Carboxy terminated polybutadiene plasticized with isodecyl pelargonate
[3]N-butyl ferrocene
[4]Average of two firings Incorporation of the inorganic oxidizer salt, preferably ammonium perchlorate, into the boron agglomerate particles has been found to have the unique effect of increasing the pressure exponent (n), namely the rate of increase in burning rate with increasing combustion chamber pressure. The increase is substantially progressive with increase in the proportion of oxidizer in the agglomerates relative to the proportion remaining in the propellant fuel binder. The increase in $n$ is accompanied by a progressive decrease in burning rate ($r$) as the percent of oxidizer is progressively increased in the beads. The decrease in $r$, however, levels off when approximately half of the oxidizer has been incorporated into the beads. Continued addition of the oxidizer to the boron agglomerates then tend to show increased burning rates until all of the oxidizer has been included in the agglomerates, with none in the propellant organic fuel binder.

This leveling off of $r$, as well as its increase while $n$ continues to rise is very surprising inasmuch as $b.r.$ at a given chamber pressure normally tends to move in a direction opposite to that of $n$.

These phenomena are shown in Table II. The formulation used in all of the tests comprised 52% boron (2–3μ, analysis 94–96% boron; 2–4% $B_2O_3$, $H_2BO_3$-:<1% Mg), 25% ammonium perchlorate, and 23% binder (plasticized carboxy-terminated polybutadiene which includes 6% n-butyl ferrocene (NBF), a burning rate catalyst. The boron and boron-oxidizer agglomerate particles were spherical with the boron and boron-oxidizer particles bonded together by means of about 6% carboxy-terminated polybutadiene by weight of the agglomerate. All percentages are by weight. All of the boron was ball-milled prior to use.

The data in Table II also show the marked increase in burning rate when at least a portion of the total boron is introduced in the form of agglomerate particles.

TABLE II

| Total Boron | Wt. % boron in Propellant binder | Wt. % Beads | Wt. % AP in Propellant Binder | Wt. % AP in Beads | NBF | 1000 psi $r_b$ | 1000 psi n |
|---|---|---|---|---|---|---|---|
| 52 | 52 | 0 | 25 | 0 | 6 | 0.35 | 0.35 |
| 52 | 26 | 27.3 | 25 | 0 | 6 | 0.60 | 0.20 |
| 52 | 26 | 29.0 | 23.6 | 1.4 | 6 | 0.59 | 0.30 |
| 52 | 26 | 30.6 | 22.1 | 2.9 | 6 | 0.55 | 0.25 |
| 52 | 26 | 32.4 | 20.4 | 4.6 | 6 | 0.57 | 0.35 |
| 52 | 26 | 32.8 | 20.0 | 5.0 | 6 | 0.39 | 0.34 |
| 52 | 26 | 38.2 | 15.0 | 10.0 | 6 | 0.36 | 0.36 |
| 52 | 26 | 43.4 | 10.0 | 15.0 | 6 | 0.36 | 0.40 |
| 52 | 26 | 48.7 | 5.0 | 20.0 | 6 | 0.40 | 0.53 |
| 52 | 26 | 54. | 0 | 25.0 | 6 | 0.49 | 0.57 |

The high pressure exponents obtainable by incorporating the oxidizers in the boron agglomerate particles is particularly advantageous for applications where controllability is desired of the degree of thrust of the air-augmented rocket in flight. This is primarily accomplished by changing the burning rate of the propellant by controlled change in combustion chamber pressure. Such change in burning rate can be achieved by controlled change in throat diameter of the nozzle, as for example by use of a pintle valve. The degree of change in burning rate, however, is controlled by the pressure exponent of the propellant. The higher is $n$, the greater is the rate of change of burning rate for a given change in nozzle throat diameter. Thus by using a propellant having a high pressure exponent, response is more rapid and the required operating limits of nozzle throat diameter are much smaller.

The data in Table III shows a similar effect of increasing pressure exponent with increased percentage of oxidizer in a higher boron content propellant formulation.

TABLE III

| Wt. % Total B | Wt. % B in Beads | Wt. % Beads | Wt. % Total AP | Wt. % in Beads | $r_b$ 200 psia | $r_b$ 2000 psia | 200 $n_{2000}$ |
|---|---|---|---|---|---|---|---|
| 55 | 11.2 | 14.0 | 22.0 | 2.0 | 0.16 | 0.40 | 0.42 |
| 55 | 6.72 | 14.0 | 22.0 | 6.44 | 0.093 | 0.45 | 0.65 |
| 55[1] | 6.72 | 14.0 | 22.0 | 6.44 | 0.12 | 0.43 | 0.55 |

[1]2% Al by weight added to propellant fuel binder and replaced 2% of binder.

Minor amounts of other metals such as Al, Mg, or Zr can be used in the air-augment propellant to improve ignition efficiency and, therefore, combustion efficiency in the afterburner. Since they ignite more readily than boron, their combustion in the afterburner rapidly raises the temperature to a level at which the boron more readily ignites. As indicated in Table III supra and in Table IV, such metal powders can be incorporated into the propellant fuel binder and/or into the boron-agglomerate particles. It should be noted that when the metal is added to the binder, it tends to reduce pressure exponent somewhat as compared with the formulation without the added metal. Addition to the boron-agglomerate tends to depress pressure exponent even more.

TABLE IV

| Wt. % Total B | Wt. % B in Beads | Wt. % Beads | Wt. % Total AP | Wt. % AP in Beads | Wt. % Added Metal | $r_b$ 200 psia | $r_b$ 2000 psia | 200 $n_{2000}$ |
|---|---|---|---|---|---|---|---|---|
| 50 | 6.7 | 14.0 | 25.0 | 6.4 | Al 4% [1] | 0.195 | 0.57 | 0.50 |
| 50 | 6.7 | 14.0 | 25.0 | 6.4 | Al 4%[2] | 0.27 | 0.63 | 0.38 |
| 50 | 16.0 | 21.2 | 25.0 | 0 | Mg 4%[3] | 0.36 | 0.55 | 0.22 |

[1]Added to propellant fuel binder.
[2]Added to boron beads.
[3]Added to boron beads.

I claim:

1. A fuel-rich propellant composition, the combustion products of which include a substantial proportion of a high-energy fuel in the form of free boron for downstream ejection, wherein said propellant comprises:

a. a fuel binder comprising an organic polymer,
b. an inorganic oxidizer salt,
c. finely-divided boron,
d. said oxidizer salt and said boron being dispersed in said fuel binder, and is further characterized by:
e. said boron fuel being present in amount at least 25% by weight of the propellant,
f. said binder being present in an amount at least about 10% by weight of the propellant,
g. said oxidizer salt being present in amount adequate to maintain combustion of the propellant composition, the maximum amount being about the calculated amount required to oxidize available carbon in the binder to carbon monoxide,
h. at least a portion of said boron being in the form of agglomerate particles essentially consisting of said boron as high-energy fuel component, said agglomerate particles being dispersed in said fuel binder, and a major proportion by weight of said agglomerate particles being in a size range of about −12 to +60 Tyler Standard screen mesh size, and
i. from 0 to 100% of said oxidizer being admixed with the boron in said agglomerate particles.

2. The propellant composition of claim 1 in which said agglomerate particles are spheroidal and said boron and said oxidizer in said agglomerate particles are bonded by an organic polymer.

3. The propellant composition of claim 1 in which at least 10% by weight of said oxidizer is admixed with the boron in said agglomerate particles.

4. The propellant composition of claim 2 in which at least 10% by weight of said oxidizer is admixed with the boron in said agglomerate particles.

5. The propellant composition of claim 1 in which the inorganic oxidizer salt is ammonium perchlorate.

6. The propellant composition of claim 2 in which the inorganic oxidizer salt is ammonium perchlorate.

7. The propellant composition of claim 3 in which the inorganic oxidizer salt is ammonium perchlorate.

8. The propellant composition of claim 4 in which the inorganic oxidizer salt is ammonium perchlorate.

9. The propellant composition of claim 1 in which said fuel binder is carboxy-terminated polybutadiene.

10. The propellant composition of claim 3 in which said fuel binder is carboxy-terminated polybutadiene.

11. The propellant compositions of claim 1 wherein the agglomerate particles are spheroidal.

12. The propellant compositions of claim 5 wherein the agglomerate particles are spheroidal.

* * * * *